US005842423A

United States Patent [19]

Stranford

[11] Patent Number: 5,842,423

[45] **Date of Patent: *Dec. 1, 1998**

[54] TELEVISION SUPPORTED SHELF

[76] Inventor: James A. Stranford, 107 13th St., Altoona, Pa. 16602

[ * ] Notice: The term of this patent shall not extend beyond the expiration date of Pat. No. 5,584,253.

[21] Appl. No.: 854,242

[22] Filed: May 9, 1997

[51] Int. Cl.[6] ..... A47B 23/00

[52] U.S. Cl. ..... 108/42; 108/90

[58] Field of Search ..... 108/42, 53.1, 53.3, 108/53.5, 54.1, 157.16, 56.3, 157.1, 157.15, 153.1, 180, 156, 157.14, 157.17, 157.18, 158.11, 158.12, 57.31, 190, 186, 91, 92

[56] References Cited

U.S. PATENT DOCUMENTS

| | | | |
|---|---|---|---|
| 3,930,701 | 1/1976 | Otakie | 108/42 X |
| 4,619,386 | 10/1986 | Richardson | 108/44 X |
| 4,838,176 | 6/1989 | Bowser, Sr. et al. | 108/53.3 |
| 4,870,907 | 10/1989 | McKee | 108/42 |
| 5,158,023 | 10/1992 | Allen | 108/42 |
| 5,400,719 | 3/1995 | Santapa et al. | 108/91 X |
| 5,579,702 | 12/1996 | Aho | 108/91 X |
| 5,584,253 | 12/1996 | Stranford | 108/42 |

*Primary Examiner*—José V. Chen

[57] ABSTRACT

A shelf for supporting objects relative to a television. The inventive device includes a shelf panel positionable upon a front portion top surface of a television so as to project rearwardly therefrom. A support assembly depends from the shelf panel to engage a rear portion top surface of the television to maintain the shelf panel in a horizontal orientation for the supporting of objects thereon. The coupling between the support assembly and the shelf is swivelable in nature to afford a more versatile engagement with the rear portion top surface of the television.

5 Claims, 4 Drawing Sheets

FIG 3
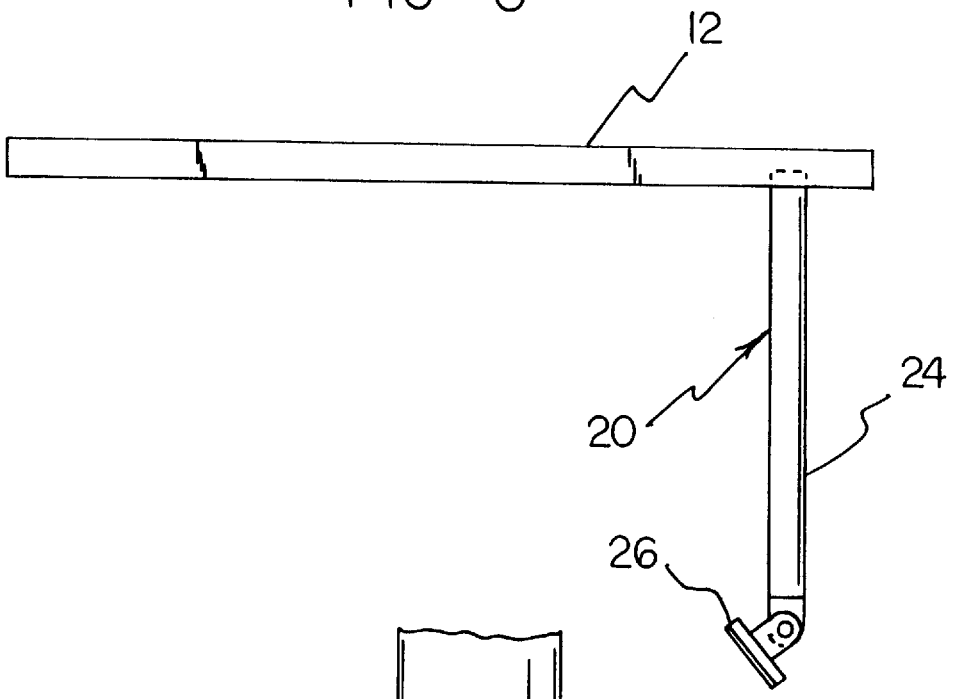
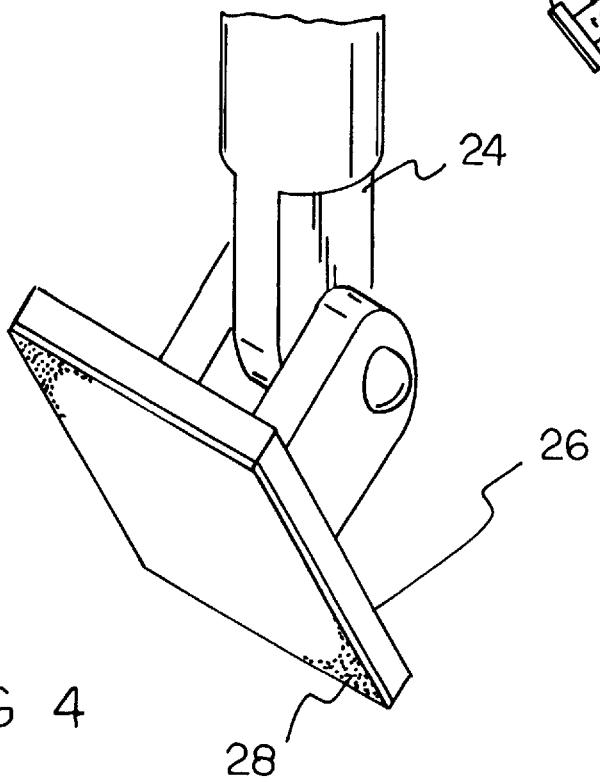
FIG 4

TELEVISION SUPPORTED SHELF

BACKGROUND OF THE INVENTION

1. Field of the Invention

The present invention relates to shelf structures and more particularly pertains to a television supported shelf for supporting objects relative to any one of various types of televisions.

2. Description of the Prior Art

The use of shelf structures is known in the prior art. More specifically, shelf structures heretofore devised and utilized are known to consist basically of familiar, expected and obvious structural configurations, notwithstanding the myriad of designs encompassed by the crowded prior art which have been developed for the fulfillment of countless objectives and requirements. Known prior art shelf structures include U.S. Pat. No. 5,240,119; U.S. Pat. No. 5,216,211; U.S. Pat. No. 5,354,125; U.S. Pat. No. 5,188,246; U.S. Design Pat. No. 292,254; and U.S. Design Pat. No. 335,051.

The most pertinent prior art device is that which is disclosed in U.S. Pat. No. 5,584,253 to Stranford. Such device discloses a non-rotatable coupling between the shelf and support assembly thereof. By this structure, the rectangular pads of the support assembly are capable of only pivoting about a single axis. This renders it very difficult for the support assembly to accommodate televisions that have top face rear portions with varying slopes.

While these devices fulfill their respective, particular objectives and requirements, the aforementioned patents do not disclose a television supported shelf for supporting objects relative to a television which includes a shelf panel positionable upon a front portion top surface of a television so as to project rearwardly therefrom, and a support assembly depending from the shelf panel for engaging a rear portion top surface of television to maintain the shelf panel in a horizontal orientation for supporting of objects thereon, wherein the coupling between the support assembly and the shelf is swivelable in nature to afford a more versatile engagement with the rear portion top surface of the television.

In these respects, the television supported shelf according to the present invention substantially departs from the conventional concepts and designs of the prior art, and in so doing provides an apparatus primarily developed for the purpose of supporting objects relative to any one of various types of televisions.

SUMMARY OF THE INVENTION

In view of the foregoing disadvantages inherent in the known types of shelf structures now present in the prior art, the present invention provides a new television supported shelf construction wherein the same can be utilized for supporting objects upon a top surface of a television. As such, the general purpose of the present invention, which will be described subsequently in greater detail, is to provide a new television supported shelf apparatus and method which has many of the advantages of the shelf structures mentioned heretofore and many novel features that result in a television supported shelf which is not anticipated, rendered obvious, suggested, or even implied by any of the prior art shelf structures, either alone or in any combination thereof.

To attain this, the present invention generally comprises a shelf for supporting objects relative to a television. The inventive device includes a shelf panel positionable upon a front portion top surface of a television so as to project rearwardly therefrom. A support assembly depends from the shelf panel to engage a rear portion top surface of the television to maintain the shelf panel in a horizontal orientation for the supporting of objects thereon. The support assembly and the shelf are coupled such that they are swivelable with respect to each other. This affords a more versatile means of engaging the rear portion top surface of different televisions.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved television supported shelf which has all the advantages of the prior art shelf structures and none of the disadvantages.

It is another object of the present invention to provide a new and improved television supported shelf which may be easily and efficiently manufactured and marketed.

It is a further object of the present invention to provide a new and improved television supported shelf which is of a durable and reliable construction.

An even further object of the present invention is to provide a new and improved television supported shelf which is susceptible of a low cost of manufacture with regard to both materials and labor, and which accordingly is then susceptible of low prices of sale to the consuming public, thereby making such television supported shelf economically available to the buying public.

Still yet another object of the present invention is to provide a new and improved television supported shelf which provides in the apparatuses and methods of the prior art some of the advantages thereof, while simultaneously overcoming some of the disadvantages normally associated therewith.

Still another object of the present invention is to support objects relative to any one of various types of televisions by means of a versatile swivelable support assembly.

Lastly, it is an object of the present invention to provide a new and improved shelf for supporting objects relative to a television. The inventive device includes a shelf panel positionable upon a front portion top surface of a television so as to project rearwardly therefrom. A support assembly depends from the shelf panel to engage a rear portion top surface of the television to maintain the shelf panel in a horizontal orientation for the supporting of objects thereon. The coupling between the support assembly and the shelf is swivelable in nature to afford a more versatile engagement with the rear portion top surface of the television.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

BRIEF DESCRIPTION OF THE DRAWINGS

Figures 1, 2:
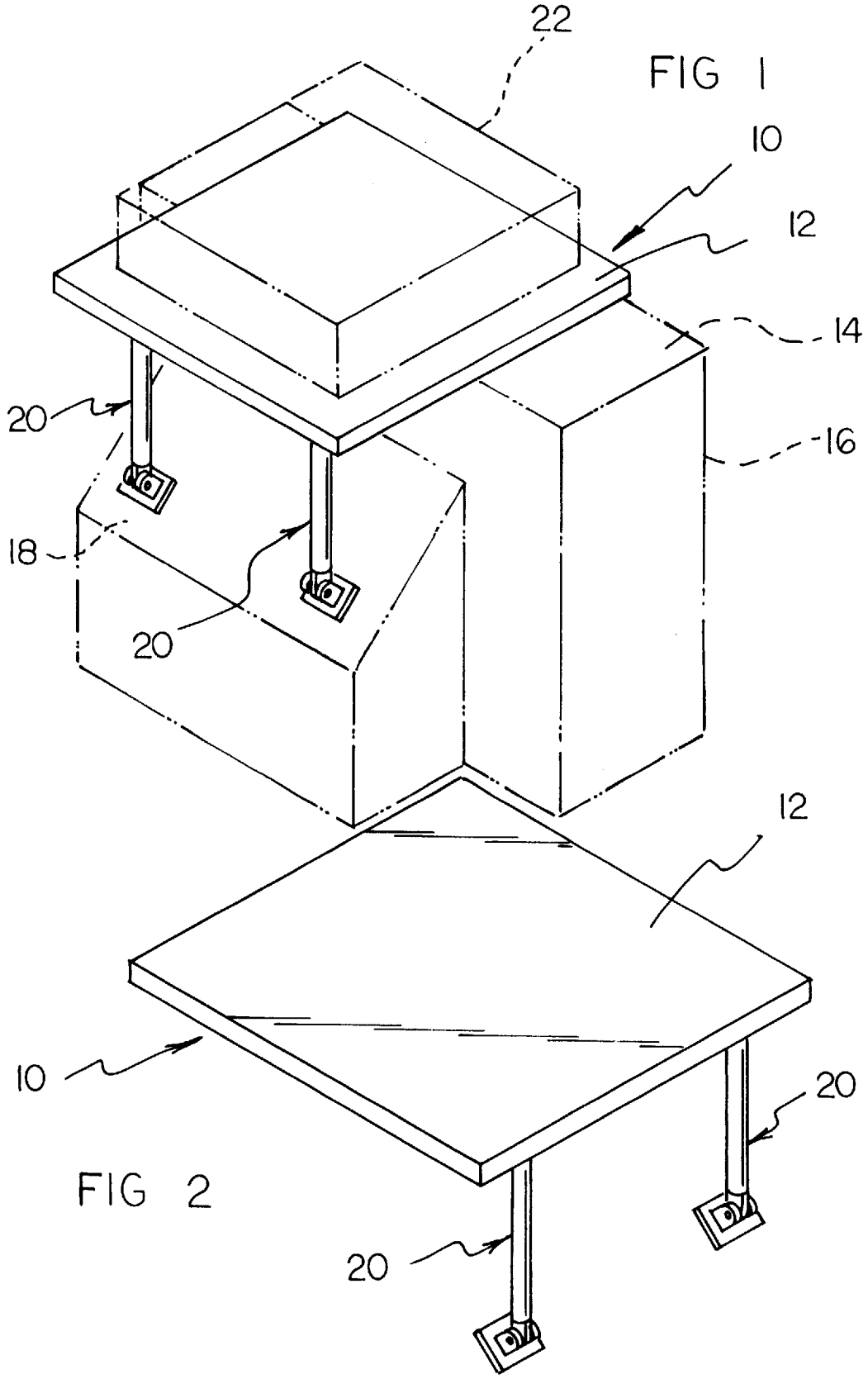

The invention will be better understood and objects other than those set forth above will become apparent when consideration is given to the following detailed description thereof. Such description makes reference to the annexed drawings wherein:

FIG. 1 is an isometric illustration of a television supported shelf according to the present invention in use.

FIG. 2 is an isometric illustration of the present invention, per se.

FIG. 3 is a side elevation view thereof.

FIG. 4 is an enlarged isometric illustration of a portion of the invention.

Figure 5:
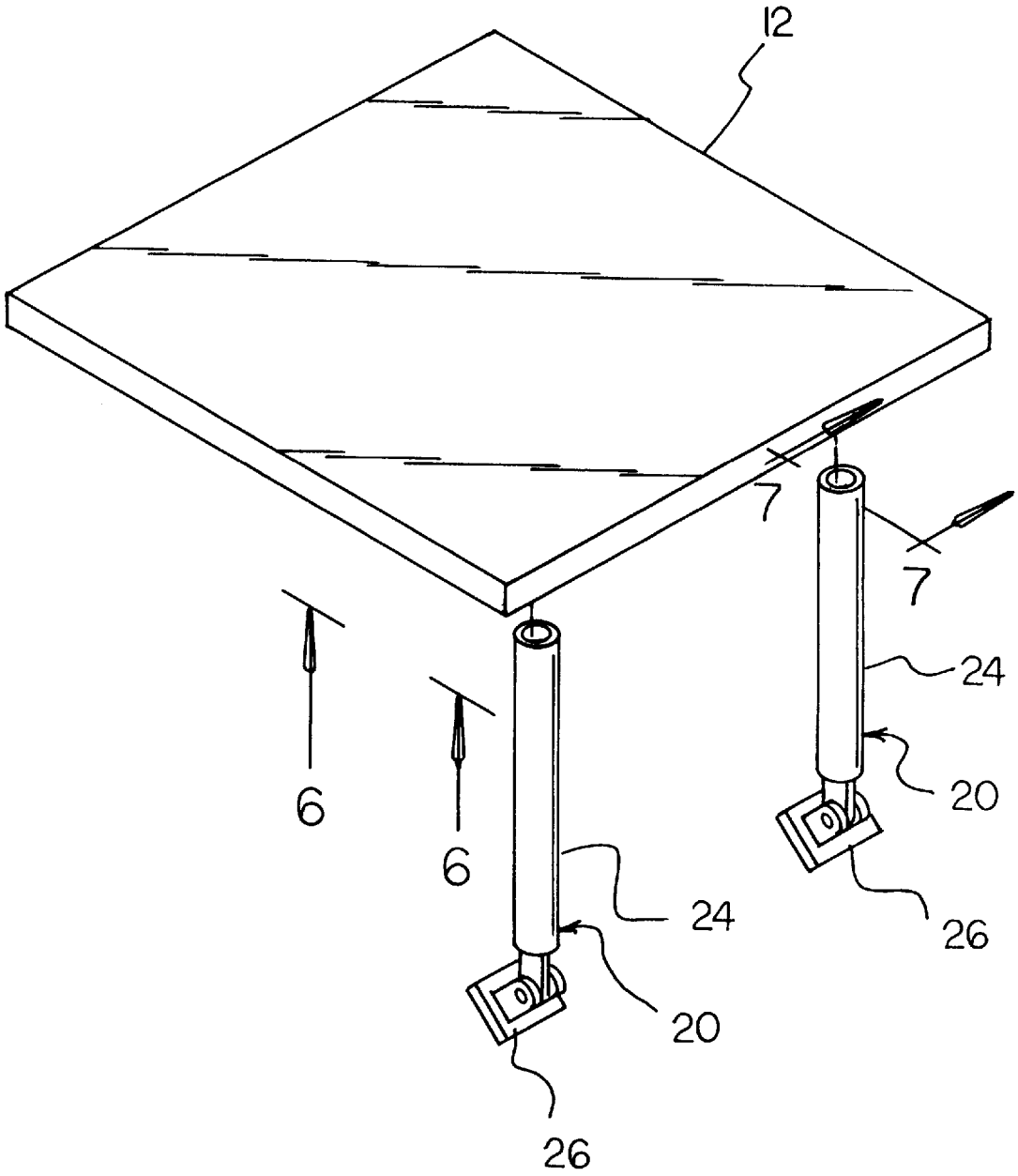

FIG. 5 is an exploded isometric illustration of the invention.

Figure 6:
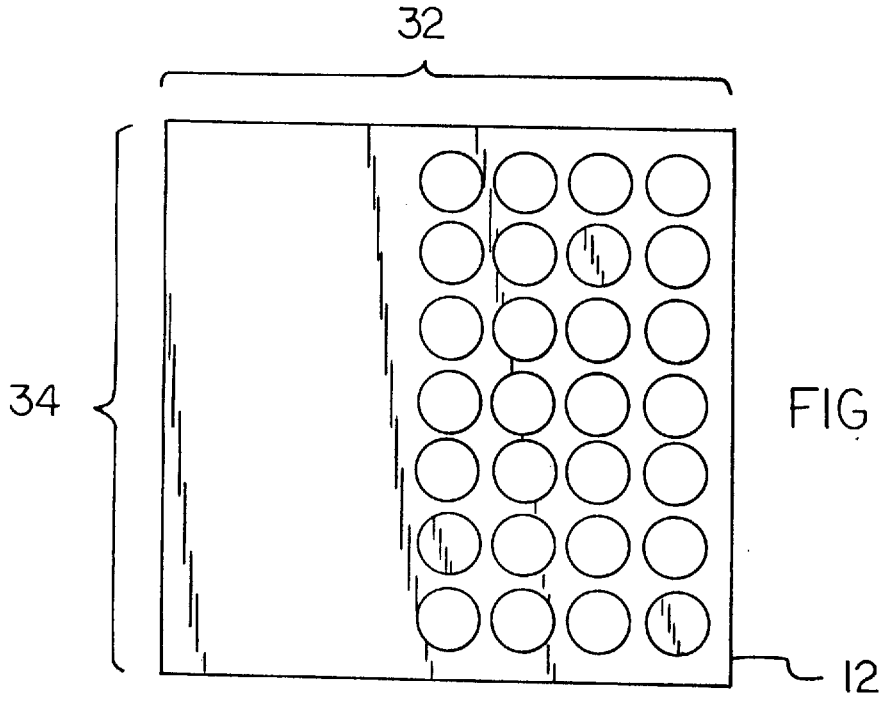

FIG. 6 is a bottom plan view of a shelf panel comprising a portion of the present invention as viewed from line 6—6 of FIG. 5

Figure 7:
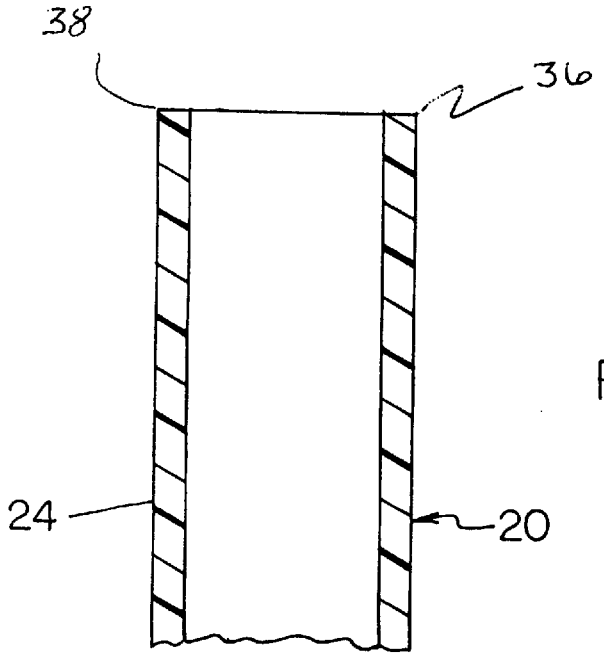

FIG. 7 is a cross sectional view taken along line 7—7 of FIG. 5.

Similar reference characters refer to similar parts throughout the several views of the drawings.

DESCRIPTION OF THE PREFERRED EMBODIMENT

With reference now to the drawings, and in particular to FIGS. 1–7 thereof, a new television supported shelf embodying the principles and concepts of the present invention and generally designated by the reference numeral 10 will be described.

More specifically, it will be noted that the television supported shelf 10 comprises a shelf panel 12 positionable upon a front portion top surface 14 of a television 16, or more generally, a cathode ray tube, substantially as shown in FIG. 1 of the drawings. The shelf panel 12 is dimensioned so as to extend rearwardly beyond and off the front portion top surface 14 of the television 16 so as to reside in a spaced orientation relative to a rear portion top surface 18 of the television. A support means 20 is coupled to a lower surface of the shelf panel 12 and depends therefrom for engaging the rear portion top surface 18 of the television 16 to support the shelf panel 12 in a horizontal orientation such that objects can be positioned thereon. By this structure, an individual can securely support an object such as a VCR 22 upon a television 16.

Referring now to FIGS. 2 through 4 of the drawings wherein the present invention 10 is illustrated in detail, it can be shown that the support means 20 of the present invention 10 preferably comprises a stanchion 24 coupled to the lower surface of the shelf panel 12 and projecting substantially orthogonally downwardly therefrom. An engaging foot 26 is pivotally mounted to a lower end of the stanchion and includes a adhesive pad 28 coupled thereto which can be adhesively secured to the rear portion top surface 18 of the television 16. As shown in the Figures, the pad is adapted to pivot about a single axis. By this structure, the support means 20 operates to support a rearward edge of the shelf panel 12 relative to the rear portion top surface 18 of the television 16 to preclude a pivoting of the shelf panel 12 from the front portion top surface 14 upon which the forward portion of the shelf panel is residing.

Referring now to FIGS. 5 through 7, it can be shown that the stanchion 24 of the support means 20 is preferably mounted to the lower surface of the shelf panel 12 by an adjustable coupling means 30 defined by an upper end of the stanchion 24 for adjustably securing the upper end of the stanchion to the lower surface of the shelf panel 12. To this end, and as shown in FIGS. 6 and 7, the lower surface of the shelf panel 12 is preferably shaped so as to define a matrix of adjacent circular bores including a plurality of columns of adjacent circular bores 32 and a plurality of rows of adjacent circular bores 34 formed in the lower surface of the shelf panel 12. The plurality of columns of adjacent circular bores 32 is oriented so as to extend substantially orthogonally relative to the plurality of rows of adjacent circular bores 34 so as to define the matrix of adjacent circular bores as shown in FIG. 6 of the drawings. The adjustable coupling means 30, as shown in FIG. 7, further comprises a mounting head 36 located at the upper end of the stanchion 24 and shaped so as to define a cylinder 38. By this structure, the adjustable coupling means 30 permits the mounting head to be inserted into the adjacent circular bores 32 and 34 of the shelf panel 12, whereby the stanchions are capable of swivelling about a vertical axis. Preferably, the present invention 10 utilizes a pair of support means 20 positioned in a substantially spaced and parallel orientation as shown in FIGS. 1 and 2 of the drawings. By affording the aforementioned swivelling, the adjustable coupling means is adapted to allow optimal engagement of the pads on rear portion top surfaces of televisions that not only slope downwardly and rearwardly, but also downwardly and sidewardly to various degrees.

In use, the television supported shelf 10 according to the present invention can be easily utilized for supporting objects such as a VCR 22 relative to a television 16, as shown in FIG. 1 of the drawings.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cathode ray tube supported shelf comprising:

a shelf panel positionable upon a front portion top surface of a cathode ray tube, the shelf panel being dimensioned so as to extend rearwardly beyond and off the front portion top surface of the cathode ray tube so as to reside in a spaced orientation relative to a rear portion top surface of the cathode ray tube;

a support means coupled to a lower surface of the shelf panel and depending therefrom for engaging the rear portion top surface of the cathode ray tube to support the shelf panel in a horizontal orientation, the support means being adjustably coupled to the lower surface of the shelf panel, the support means comprising a stanchion adjustably coupled to the lower surface of the shelf panel and projecting downwardly therefrom, and an engaging foot mounted to a lower end of the stanchion, the engaging foot pivotally mounted to the lower end of the stanchion, the engaging foot including an adhesive pad coupled thereto which can be adhesively secured to the rear portion top surface of the cathode ray tube, the stanchion of the support means being adjustably mounted to the lower surface of the shelf panel by an adjustable coupling means mounted to an upper end of the stanchion for adjustably securing the upper end of the stanchion to the lower surface of the shelf panel, the lower surface of the shelf panel shaped so as to define a matrix of adjacent circular bores, wherein the adjustable coupling means comprises a mounting head located at the upper end of the stanchion of the support means, the mounting head being shaped so as to define a cylinder that is situated within the adjacent circular bores of the shelf panel such that the same may be swiveled about its axis.

2. The cathode ray tube supported shelf of claim 1, wherein the matrix of adjacent circular bores includes a plurality of columns of adjacent circular bores and a plurality of rows of adjacent circular bores formed in the lower surface of the shelf panel, the columns of adjacent circular bores being oriented so as to extend substantially orthogonally relative to the plurality of rows of adjacent circular bores so as to define the matrix of adjacent circular bores.

3. A cathode ray tube supported shelf comprising:

a cathode ray tube having a front portion top surface and a rear portion top surface;

a shelf panel positioned upon the front portion top surface of a cathode ray tube, the shelf panel being dimensioned so as to extend rearwardly beyond and off the front portion top surface of the cathode ray tube so as to reside in a spaced orientation relative to the rear portion top surface of the cathode ray tube;

a support means coupled to a lower surface of the shelf panel and depending therefrom for engaging the rear portion top surface of the cathode ray tube to support the shelf panel in a horizontal orientation, the support means being adjustably coupled to the lower surface of the shelf panel, the support means comprising a stanchion adjustably coupled to the lower surface of the shelf panel and projecting downwardly therefrom, an engaging foot mounted to a lower end of the stanchion, the engaging foot pivotally mounted to the lower end of the stanchion, the engaging foot including a adhesive pad coupled thereto and adhesively secured to the rear portion top surface of the cathode ray tube, the stanchion of the support means being adjustably mounted to the lower surface of the shelf panel by an adjustable coupling means mounted to an upper end of the stanchion for adjustably securing the upper end of the stanchion to the lower surface of the shelf panel, the lower surface of the shelf panel shaped so as to define a matrix of adjacent circular bores, wherein the adjustable coupling means comprises a mounting head located at the upper end of the stanchion of the support means, the mounting head being shaped so as to define a cylinder that is situated within the circular bores of the shelf panel such that the same may be swiveled about its axis.

4. The cathode ray tube supported shelf of claim 3, wherein the matrix of adjacent circular bores includes a plurality of columns of adjacent circular bores and a plurality of rows of adjacent circular bores formed in the lower surface of the shelf panel, the columns of adjacent circular bores being oriented so as to extend substantially orthogonally relative to the plurality of rows of adjacent circular bores so as to define the matrix of adjacent circular bores.

5. A cathode ray tube supported shelf comprising:

a shelf panel positionable upon a front portion top surface of a cathode ray tube, the shelf panel being dimensioned so as to extend rearwardly beyond and off the front portion top surface of the cathode ray tube so as to reside in a spaced orientation relative to a rear portion top surface of the cathode ray tube;

a support means coupled to a lower surface of the shelf panel and depending therefrom for engaging the rear portion top surface of the cathode ray tube to support the shelf panel in a horizontal orientation; and adjustable coupling means including at least one circular bore formed in the lower surface of the shelf panel, wherein the adjustable coupling means further comprises a mounting head secured to an upper end of the support means, the mounting head having a circular shape that is situated within the at least one circular bore of the shelf panel such that the same may be swiveled about its axis.

* * * * *